United States Patent [19]

Steimel

[11] 4,085,889

[45] Apr. 25, 1978

[54] CENTRIFUGE HAVING SEPARABLE CENTRIFUGE VESSEL

[76] Inventor: Richard Steimel, Frankfurter Strasse 134, 5202 Hennef, Sieg, Germany

[21] Appl. No.: 739,339

[22] Filed: Nov. 5, 1976

[51] Int. Cl.[2] ..... B04B 9/02; B04B 7/04; B04B 15/06

[52] U.S. Cl. ..... 233/20 R; 233/46; 233/24; 233/1 C

[58] Field of Search ..... 233/1 C, 1 R, 1 A, 3, 233/20 R, 20 A, 1 D, 14 R, 14 A, 23 R, 24, 27, 46, 47 R

[56] References Cited

U.S. PATENT DOCUMENTS 3,765,600 10/1973 Steimel ..... 233/20 R

FOREIGN PATENT DOCUMENTS 1,296,184 5/1962 France ..... 233/20 R 1,108,451 1/1956 France ..... 233/46

412,717 11/1966 Switzerland ..... 233/20 R

*Primary Examiner*—George H. Krizmanich

*Attorney, Agent, or Firm*—Michael J. Striker

[57] ABSTRACT

A centrifuge comprises a support on which an upright shaft is supported in a bearing so as to be rotatable about an upright axis but nondisplaceable axially relative to the axis. A floor member is fixed to the shaft and has a downwardly flared support surface that can engage snugly with the downwardly flared support surface of an annular wall member that may therefore rest on the floor member. This wall member has at least one radially opening hole and is provided below this wall with an outwardly extending flange. A trough surrounds the wall member below the flange and may be raised into engagement with the flange to lift this wall member off the floor member and allow material inside the centrifuge to be discharged.

10 Claims, 4 Drawing Figures

CENTRIFUGE HAVING SEPARABLE CENTRIFUGE VESSEL

BACKGROUND OF THE INVENTION

The present invention relates to a centrifuge. More particularly this invention concerns a centrifuge having a centrifuge vessel whose wall and floor are separable for emptying out the device after use.

A centrifuge is known having an upwardly open cup-shaped vessel formed of a floor member and, separable therefrom, a generally cylindrically tubular wall member. The floor member is carried on the upper end of a shaft whose lower end is received in a heavy-duty bearing that permits limited canting of the shaft relative to its normal vertical axis. A motor is provided on this shaft for rotating the floor member at high speed about the upright axis of the shaft. When the wall member is resting on the floor member, usually by means of a downwardly flared frustoconical surface that mates with a corresponding surface of the floor member, this wall member is effectively entrained by the floor member.

The liquid phase of the material being centrifuged normally passes radially outwardly through one or more holes formed in the wall member. Immediately below this hole or these holes there is provided a deflecting flange which extends radially outwardly past the inner edge of an upwardly open trough. Thus the liquid exits radially over the flange and is captured in the trough.

In order to remove the solid phase after the material has been centrifuged, the wall member is normally provided with a radially outwardly extending peripheral flange which is engageable with a fixed ring within the housing of the centrifuge. The floor member is, therefore, lowered until this flange rests on the ring. Further lowering of the floor member will separate the two from each other so that the solid phase can be moved out through the annular gap formed between the coacting frustoconical support surfaces.

Such an arrangement has several problems. First of all it is necessary to locate the support bearing for the floor member relatively axially far from this floor member, as room must be provided for raising and lowering the floor member and for the motor that operates the centrifuge. Thus a long lever arm is provided for any unbalanced portions of the load to act on the support bearing. Particularly when the machine is rotating at high speed it is therefore possible for an unbalanced load to cause such wide swingings of the drum and floor member as to damage the apparatus. Another difficulty with this arrangement is that, in order to minimize the distance between the bearing and the floor member, the distance through which the floor member is displaceable in order to open the centrifuge is minimized. Relatively bulky objects being centrifuged, such as pieces of metal produced in machining operations and which are being centrifuged to degrease them, cannot move out of the centrifuge through the relatively narrow gap.

Finally, in case of failure of the support mechanism for the floor member, it is possible for this floor member to drop down and allow the load being centrifuged to move outwardly. Such failure can, therefore, result in severe damage to, if not total destruction of, the centrifuge.

SUMMARY OF THE INVENTION

It is therefore an object of the present invention to provide an improved centrifuge.

Another object is to provide such a centrifuge which can be opened relatively wide.

Yet another object is to provide a centrifuge wherein the distance between the support bearing for the floor member and this floor member is minimized.

These objects are attained according to the present invention in a centrifuge of the above-described general type, but wherein the shaft supporting the floor member is nondisplaceable axially in the bearing which mounts the shaft on the support for rotation about an upright axis. The annular wall member is displaceable, instead, by means of a lift ring connected to raising and lowering means. This lift ring is vertically displaced up into engagement with a radially outwardly extending flange on the wall member so as to lift this wall member off the floor member.

With this arrangement it is therefore possible to minimize the distance between the support bearing and the floor member, as the floor member itself is axially nondisplaceable. At the same time the device will normally remain closed, even in case of total power failure, so that damage to the equipment is minimized. Furthermore, the wall member can be lifted relatively far off the floor member so that the entire device can be opened wide for discharging relatively bulky centrifuged items.

According to further features of this invention the lift ring is formed as part of the trough which receives the liquid phase of the material being centrifuged through the hole or holes in the side of the wall member. To this end the lifting ring and the flange have mating downwardly flared frustoconical lifting surfaces which ensure good centering of the wall member as it is lifted off the floor member. The support surfaces between the floor member and the wall member are also in accordance with this invention of frustoconical shape and define angles of between 60° and 80° to the horizontal. Thus, even when the wall member is lifted up off the floor member any liquid still draining down over the flange is received in the trough.

In accordance with this invention the trough which constitutes or is part of the lifting ring is vertically displaceable along one or more columns mounted in the housing and extending parallel to the axis. The trough is provided with sleeves snugly surrounding and axially slidable along these columns or posts so as effectively to guide this trough. The raising and lowering means may therefore be a simple hydraulic cylinder.

According to yet another feature of the present invention compressed-gas nozzles are provided for cleaning off the support surfaces of the floor and wall member. One such nozzle is provided on the housing and is directed at the floor member so that this floor member can be slowly rotated in front of it and all of the material adhering to its support surface can be blown off. Another such nozzle is provided formed directly in the floor member so that the floor member, when lowered, can be rotated and the nozzle will sweep off any material on the support surface of the wall member.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF A PREFERRED EMBODIMENT

Figure 1:
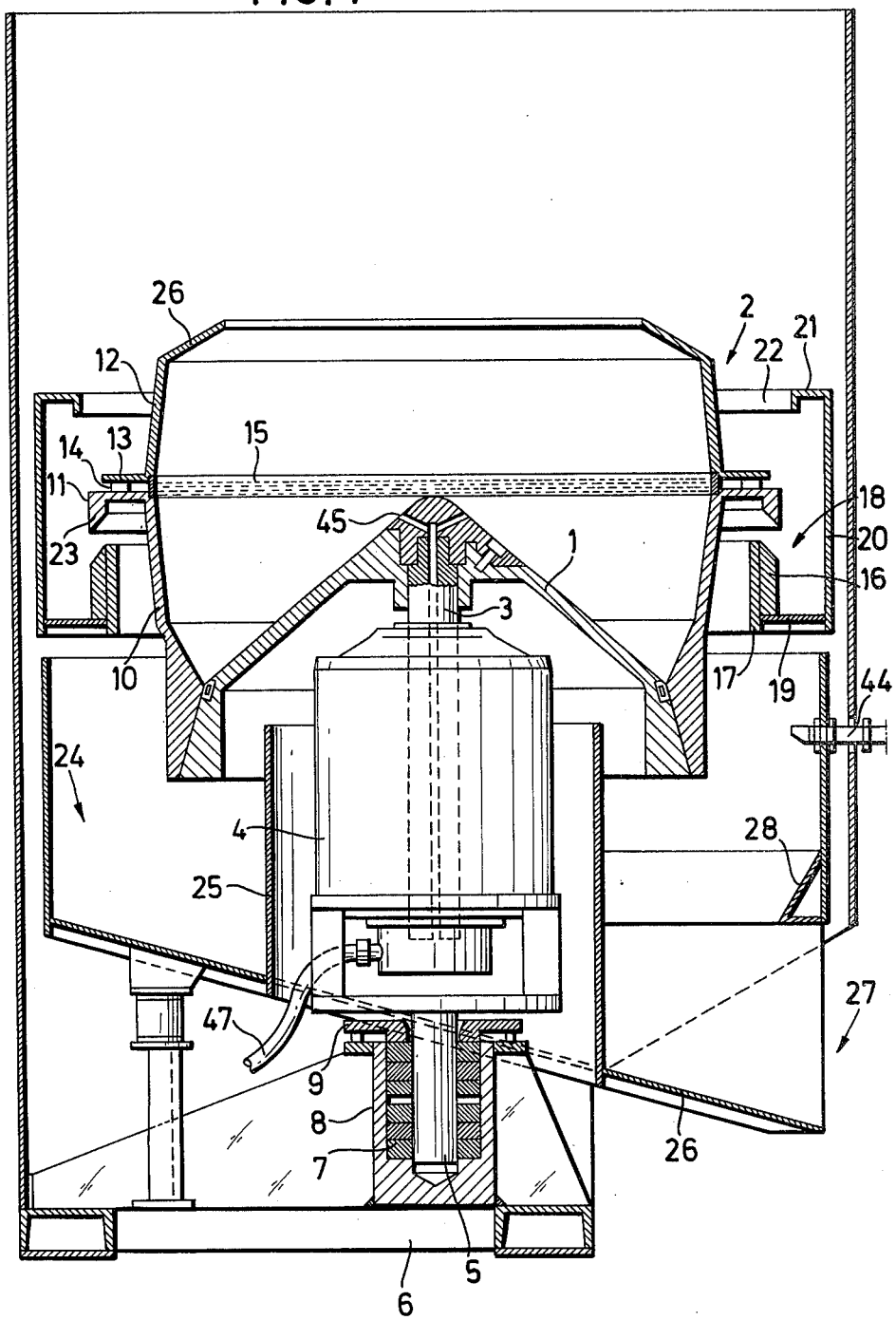
FIG. 1 is a vertical section through a centrifuge according to this invention.
Figure 2:
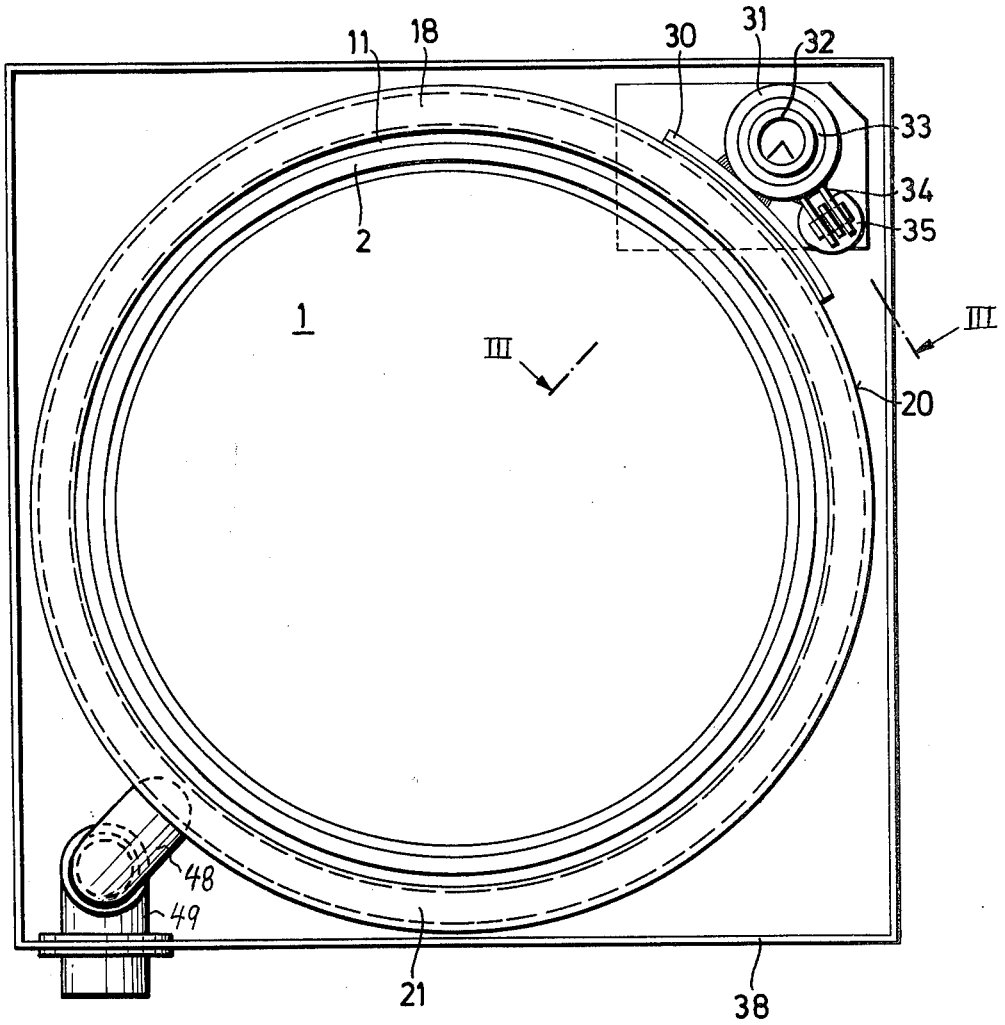
FIG. 2 is a top view of the centrifuge shown in FIG. 1.

As is shown in FIGS. 1 and 2 a centrifuge according to this invention basically comprises a floor member 1 and a wall member 2. The floor member 1 is carried on an upright axis-defining shaft 3 seated on a motor 4 itself carried on a shaft 5 which is in turn secured via elastomeric washers 7 in a socket 8 on the base or support 6 of the centrifuge. The shafts 3 and 5 are effectively one piece as far as axial or horizontal displacement of the member 1 is concerned, the portion 3 merely being rotatable relative to the portion 5 by means of the motor 4. The amount of compression of the washer 7 can be controlled by a packing ring 9 in order to limit the deflectability of the shaft 3, 5.

The wall member 2 is formed as a body of revolution and has a wall portion 10 from which extends a flange 11 having a downwardly projecting lip 23 with a frustoconical lower surface centered on the axis of the shaft 3, 5. The wall member 2 further comprises an upwardly tapered wall portion 12 having a flange 13 separated by spacers 14 and secured to the flange 11. A multiplicity of holes 15 are formed between the two members 10 and 12 so that the liquid phase of material being centrifuged can exit readily.

Below the flange 11 there is provided a lift ring formed as a trough 18 having a cylindrical inner wall centered on the axis of the shaft 3, 5 and to whose lower edge is secured an annular plate 19 having an outer periphery secured to a cylindrical outer wall 20 whose upper edge in turn is secured to the outer periphery of another annular metal sheet 21 whose inner periphery is bent down to form a cylindrical lip 22. Thus the trough 18 is generally of C-section so as to have good strength and resistance to twisting. Inside the wall 18 having an upper frustoconical surface matable with the lower frustoconical surface of the edge 23 there is a reinforcing ring 17.

Below the vessel formed by the floor 1 and wall 2 there is a discharge chute 24 having an inner wall 25 protecting the motor 4 and shaft 3, 5 and a floor 26 inclined downwardly toward an outlet opening or port 27. An inclined deflector plate 28 is secured in the chute 24 to break the fall of any material dropping downwardly in this chute 24. This entire chute 24 is elastically supported on the base 6 and can be vibrated in order to facilitate flow of solid material toward the outlet port 27.

Figure 3:
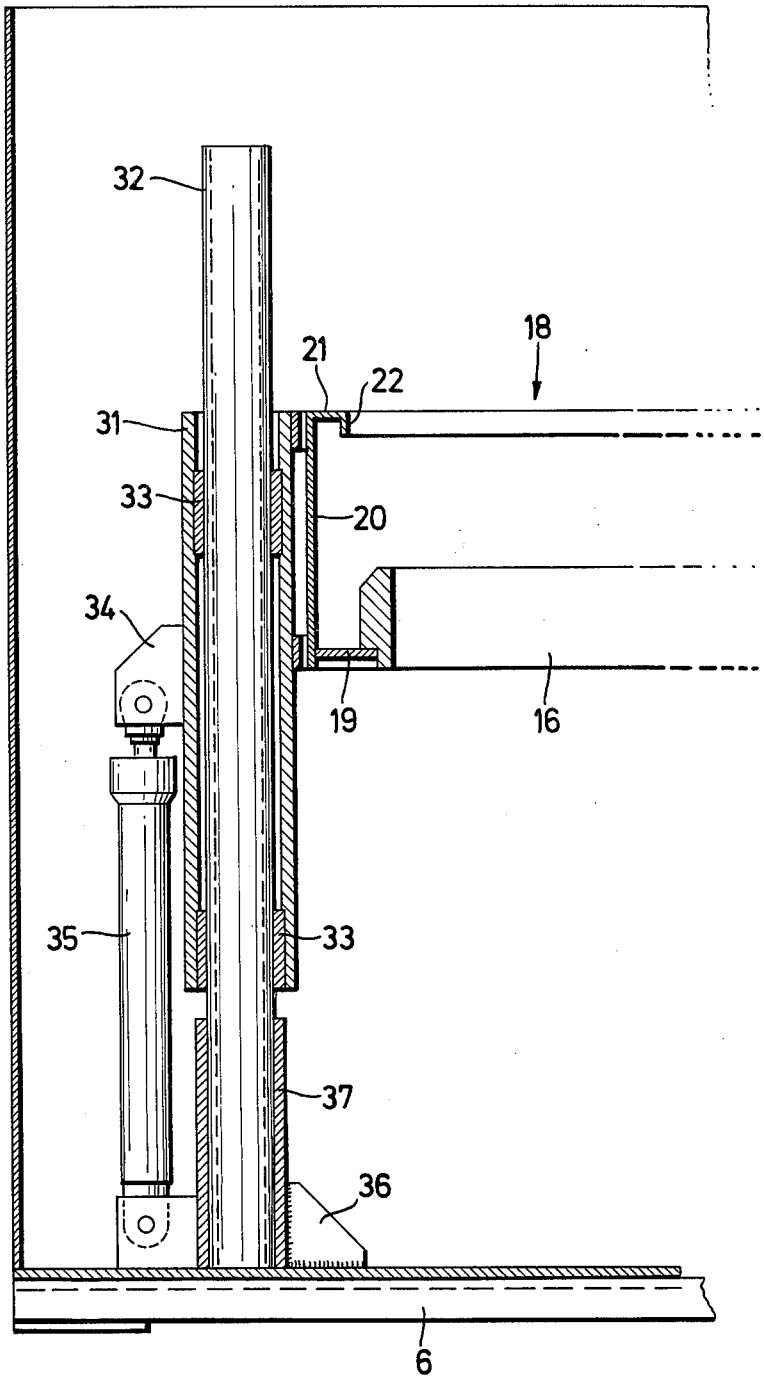
FIG. 3 is a section taken along line III—III of FIG. 2.

As also shown in FIGS. 2 and 3 the trough 18 is provided with at least one reinforcing plate 30 (FIG. 2) to which is welded an upright sleeve 31 in which a post or column 32 may telescope. Bronze slide bearings 33 are provided in the sleeve 31 and the lower end of the tube or post 32 is secured within a sleeve 37 held by means of a welded flange 36 to the support 6. The sleeve 31 carries a lug 34 connected to the piston rod of a ram 35 having a cylinder secured to the base 6.

As also shown in FIG. 2 the interior of the trough 18 communicates via an L-shaped drain pipe or tube 48 having one leg extending downwardly parallel to the axis and received within an upright tube 49. Thus, even if the trough 18 is vertically displaced all of the material in it will flow out the tube 49. The support 6 is shown to have a square housing 38 in FIG. 2, with the drain 48, 49 being provided in one corner and the lifting and lowering arrangement 30–35 being provided in the diagonally opposite corner.

Figure 4:
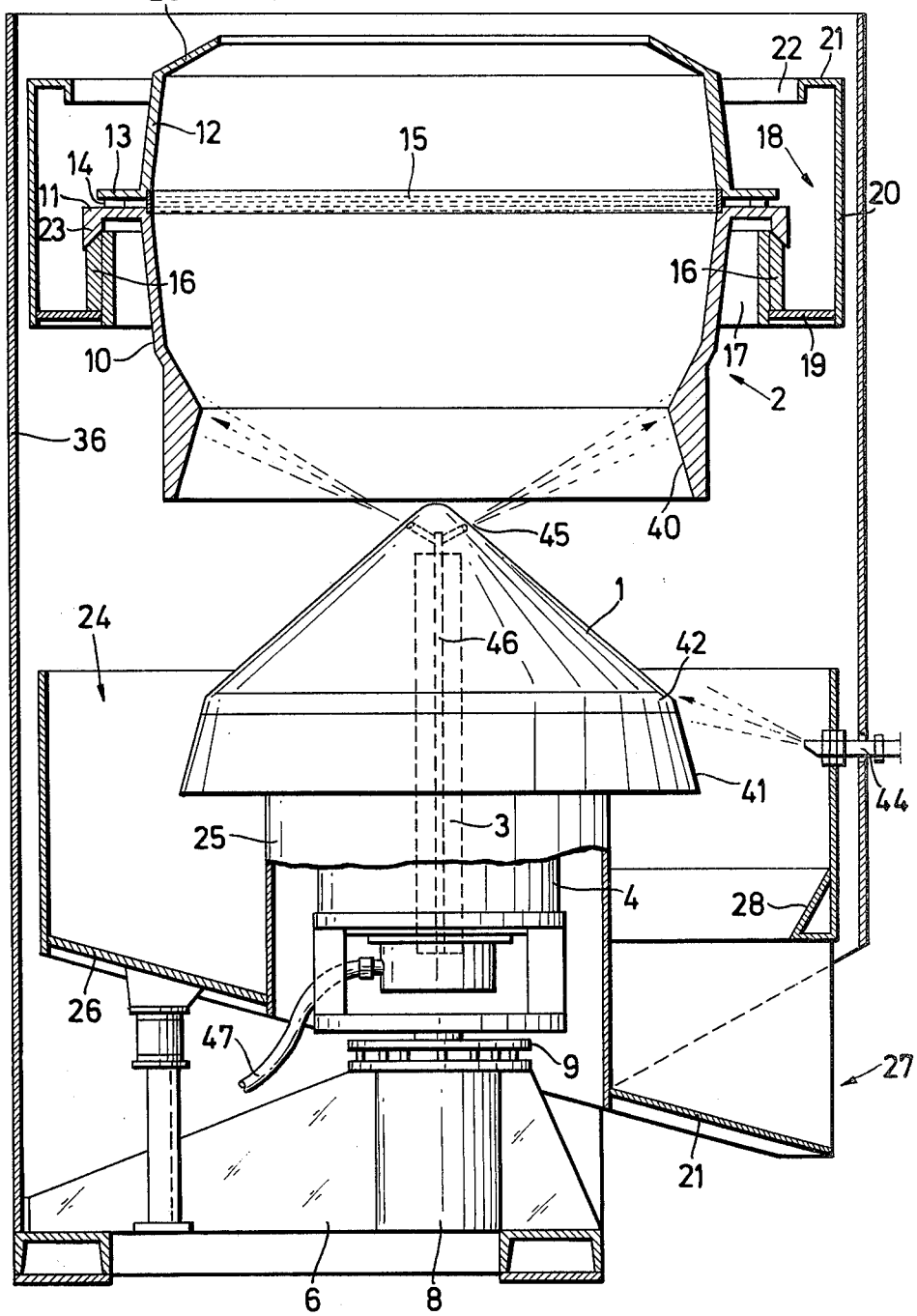
FIG. 4 is a view similar to FIG. 1 showing the centrifuge in open rather than closed condition.

As best shown in FIG. 4 the wall member has a frustoconical support surface 40 and the floor member 1 has a complementarily shaped support surface 41. These surfaces 40 and 41 extend at an angle of between 70° and 80° to the horizontal. In addition the floor member 1 is provided at the upper edge of its surface 41 with a seal ring 42 engageable with the surface 40 so as to prevent liquid from leaking out of the device into the discharge chute 24. On the level of the surface 41 the housing is provided with a compressed-gas nozzle 44 capable of blowing material adhering to this surface 41 from it. In addition the floor member 1 is formed with a pair of nozzles 45 communicating through a passage 46 to a compressed-gas hose 47 at the opposite end of the shaft part 3. These nozzles 45 allow the surfaces 40 similarly to be cleaned.

Under normal operating conditions the material to be centrifuged is dropped into the vessel formed by the floor 1 and wall 2 when it is in the position shown in FIG. 1. The motor 4 which is preferably of the hydraulic type is then operated to rotate the shaft parts 3 and 5 relative to each other at high speed and, therefore, rotate the floor member 1 which will entrain the wall member 2. The upper portion 26 of the wall 2 is tilted inwardly to prevent material from leaving the top of the wall 2, so that only the liquid phase of the material being centrifuged will exit through the perforated region 15. This liquid will pass over the flange 11 and be captured in the trough 18, whence it drains out via the pipes 48 and 49.

Once the material has been sufficiently centrifuged the motor 4 is arrested and the cylinder 35 is pressurized in order to raise the trough 18 to bring the upper frustoconical surface of the wall 16 into snug engagement with the lower frustoconical surface of the lip 23 of the flange 11. Further raising of the trough 18 will, therefore, lift the wall member 2 off the floor member 1 into the position shown in FIG. 4 with the surfaces 40 and 41 spaced from each other. The material being centrifuged will then drop out into the chute 24 which is vibrated so as to cause it to move out the outlet port 27.

The floor member 1 may then be rotated at very low speed while the nozzles 44 and 45 spray so as to clean off the surfaces 41 and 40, respectively. Thereafter the cylinder 35 may be deenergized to bring the centrifuge back into the position of FIG. 1 so that more material can be centrifuged.

It will be understood that each of the elements described above, or two or more together, may also find a useful application in other types of structure differing from the types described above.

While the invention has been illustrated and described as embodied in a centrifuge, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A centrifuge comprising:

a support;

an upright shaft;

bearing for mounting said shaft on said support rotatably about an upright axis, for preventing said shaft from moving axially, and for permitting limited horizontal displacement of said shaft relative to said support;

a floor member fixed to said shaft and having a downwardly flared support surface;

an annular wall member having a downwardly flared support surface supportable on said surface of said floor member, said wall member having at least one radially open hold and being provided below said hole with a radially outwardly extending flange;

a trough surrounding said wall member below said flange;

a lift ring surrounding said wall member below said flange; and means for raising said lift ring into engagement with said flange for lifting said wall member off said floor member and for lowering said lift ring to set said wall member with its surface on said surface of said floor member.

2. The centrifuge defined in claim 1 wherein said wall member is a body of revolution centered on said axis and has a frustoconical lifting surface flaring downwardly and centered on said axis, said lift ring having a downwardly flared lifting surface centered on said axis and engageable with said lifting surface of said wall member.

3. The centrifuge defined in claim 1 wherein said trough is mounted on and axially displaceable with said lift ring.

4. The centrifuge defined in claim 3 wherein said trough includes an inner cylindrical wall having a lower edge, an annular bottom wall extending radially outwardly from said lower edge and having an outer periphery, an outer cylindrical wall extending axially upwardly spaced from said inner wall from said outer periphery and having an upper edge, an annular top wall extending radially inwardly from said upper edge and having an inner periphery, and a lip extending axially downwardly from said inner periphery.

5. The centrifuge defined in claim 3, further comprising a post element extending parallel to and spaced from said axis and a sleeve element slidable axially along said post element, one of said elements being fixed to said trough and the other element being fixed to said support.

6. The centrifuge defined in claim 2 wherein said means for raising and lowering is a hydraulic ram connected between said lift ring and said support.

7. The centrifuge defined in claim 2 wherein said surfaces extend at an angle between 60° and 80° to the horizontal and one of said members is provided at its said surface with a seal engageable with the surface of the other member.

8. The centrifuge defined in claim 2, further comprising a compressed-gas nozzle mounted on said support and directed at said surface of said floor member.

9. The centrifuge defined in claim 2, further comprising a compressed-gas nozzle mounted on said floor member and directed at said surface of said wall member.

10. The centrifuge defined in claim 2, further comprising a drain pipe mounted rigidly on and communicating with the interior of said trough and a drain tube telescoping around said pipe and mounted on said support, said pipe and tube both being parallel to said axis.

* * * * *